US005464053A

United States Patent [19]

Moschini

[11] Patent Number: 5,464,053

[45] Date of Patent: Nov. 7, 1995

[54] PROCESS FOR PRODUCING RHEOCAST INGOTS, PARTICULARLY FROM WHICH TO PRODUCE HIGH-MECHANICAL-PERFORMANCE DIE CASTINGS

[75] Inventor: Renzo Moschini, Senigallia, Italy

[73] Assignee: Weber S.r.l., Torino, Italy

[21] Appl. No.: 118,965

[22] Filed: Sep. 9, 1993

[30] Foreign Application Priority Data

Sep. 29, 1992 [IT] Italy ..... TO92A0791

[51] Int. Cl.[6] ..... B22D 27/00; B22D 11/10

[52] U.S. Cl. ..... 164/460; 164/475; 164/415; 164/263; 164/900

[58] Field of Search ..... 164/900, 437, 164/475, 263, 134, 69.1, 66.1, 415, 460, 461, 488, 76.1

[56] References Cited

U.S. PATENT DOCUMENTS

| | | | |
|---|---|---|---|
| 2,163,967 | 6/1939 | Strawn et al. | 164/263 |
| 3,089,209 | 5/1963 | Phillips et al. | 164/475 |
| 3,952,928 | 4/1976 | Gerding et al. | 164/429 |
| 4,200,138 | 4/1980 | Hildebrandt | 164/475 |
| 4,310,352 | 1/1982 | Manfre | 75/93 |
| 4,386,958 | 6/1983 | Tyler et al. | 164/437 |
| 4,524,820 | 6/1985 | Gullotti et al. | 164/900 |
| 4,537,242 | 8/1985 | Pryor et al. | 164/900 |
| 4,781,122 | 11/1988 | Foulard et al. | 164/475 |
| 4,804,034 | 2/1989 | Leatham | 164/46 |
| 5,119,977 | 6/1992 | Moschini | 222/590 |
| 5,178,204 | 1/1993 | Kelly | 164/468 |

FOREIGN PATENT DOCUMENTS

| | | | |
|---|---|---|---|
| 0242347 | 10/1987 | European Pat. Off. | 164/900 |
| 0411329A1 | 2/1991 | European Pat. Off. . | |
| 0513523A1 | 11/1992 | European Pat. Off. . | |
| 3518333A1 | 1/1987 | Germany . | |
| 0027751 | 1/1989 | Japan | 164/900 |
| 2112676 | 7/1983 | United Kingdom . | |

OTHER PUBLICATIONS

Merton C. Flemings, "Behavior of metal alloys in the semi-solid state," Met. Trans. A, vol. 22A, pp. 957–981, May 1991.

Metals Handbook, vol. 15, Casting, pp. 327–331, 459–462 Oct. 1988.

Dr.-Ing. Waldemar Schwarzmaier, "Stranggiesben", 1957 Berliner Union GmbH, Stuttgart, p. 192, lines 22–29.

*Primary Examiner*—P. Austin Bradley
*Assistant Examiner*—James Miner
*Attorney, Agent, or Firm*—Baker & Daniels

[57] ABSTRACT

A process for semiliquid casting ingots from which to produce high-mechanical-performance die castings, whereby a metal alloy in the form of pigs and containing ceramic particles is smelted in a smelting furnace, transferred to a ladle, degassed, and fed into a pressurized furnace from which it is cast in the semiliquid state by feeding it at the solidification stage and under laminar flow conditions into a static mixer. At the outlet of the mixer the rheocast material is collected under laminar flow conditions, possibly with the interposition of a siphon type collecting tank and with protective gas shielding, through a cooled metal die, and solidified into a single billet. The billet is then guided by rollers past a saw and cut into pieces from which to obtain ingots of desired weight and size.

8 Claims, 3 Drawing Sheets

PROCESS FOR PRODUCING RHEOCAST INGOTS, PARTICULARLY FROM WHICH TO PRODUCE HIGH-MECHANICAL-PERFORMANCE DIE CASTINGS

BACKGROUND OF THE INVENTION

The present invention relates to a reliable, low-cost process for producing rheocast ingots of light alloy, particularly aluminium alloy to which ceramic particles are added, and from which to die cast internal combustion engine components.

U.S. Pat. No. 4,310,352, entitled: "Process and device for preparing a metal alloy mixture comprising a solid phase and a liquid phase," and the content of which is incorporated herein as required purely by way of reference, relates to a static mixer consisting of a cylindrical runner housing a succession of helical blades, and enabling a metal alloy to be poured and partially solidified as it flows through the mixer, while at the same time mixing the solid phase so formed with the remaining liquid phase, to produce, at the outlet of the mixer, a relatively low-viscosity solid/liquid mixture in which the segregated solid phase is uniformly suspended in the liquid alloy.

The mixture so formed remains stable long enough for it to be ladled and cast. To achieve the above characteristics, the solid/liquid mixture must be produced under stationary fluid-dynamic conditions, and provision must be made for accurately and rapidly controlling the physical and dynamic parameters involved (temperature, alloy cooling gradient, speed through the static mixer, etc.). For this purpose, the Applicant has devised a perfected semiliquid casting process as described in U.S. Pat. No. 5,119,977, entitled: "Continuous semiliquid casting process and furnace," and the content of which is incorporated herein as required purely by way of reference. According to the above process, the static mixer is connected to a pressurized tilt furnace for enabling casting under stationary conditions.

Metal alloys cast using the above semiliquid processes are known as "rheocastings", and present particularly good microstructural characteristics. In particular, rheocast light alloy has recently been found to present a globular as opposed to the usual denditric structure, thus providing for improved mechanical characteristics and workability. Semiliquid casting processes, however, cannot be employed as such for producing internal combustion engine components, which, for reasons of economy and the complex design of the components, are die cast, an operation which, by virtue of the high injection speeds involved, is performed under turbulent flow conditions. Moreover, die casting does not permit the use of several recent high-performance metal alloys incorporating a predetermined percentage of ceramic particles or fibers in the matrix.

To overcome the above drawbacks, the Applicant has devised a semiliquid die casting process employing rheocast ingots of light alloy, with or without ceramic particles, as described in U.S. patent application Ser. No. 07/870,494, now abandoned, entitled: "Process for producing high-mechanical-performance die castings via injection of a semiliquid metal alloy," and the content of which is incorporated herein as required by way of reference.

Despite presenting excellent structural characteristics, a drawback of die castings produced using the above process is that they do not allow of heat treatment. This is due to the die casting ingots having to be formed of the same weight as the component being produced, for which purpose, according to the above process, they are cut from a rheocast ingot produced by casting the semiliquid alloy from the static mixer (with or without ceramic particles) inside an ingot mold. Unfortunately, in the course of the above operation, turbulent flow is originated inside the ingot mold, thus resulting in gaseous substances being incorporated in the alloy and subsequently in the die castings, and which, during heat treatment, may possibly result in damage to the die castings or, at least, a poor surface finish (so-called "orange peel" effect) incompatible with applications requiring a good surface finish.

Semiliquid rheocasting in ingot molds also presents numerous additional drawbacks. Firstly, the ingot molds must be perfectly dry, in that, particularly in the case of aluminium alloys, even the slightest amount of humidity results in uncontrolled spatter seriously endangering the safety of the operators. Secondly, for enabling extraction of the rheocast ingots from the mold, this must be sharply cone-shaped, so that the resulting ingot presents a variable section along the longitudinal axis, thus complicating automatic cut-off of the die casting ingots, which, for a given length, differ in weight depending on the axial position in which the rheocast ingot is cut. Thirdly, any change in the crosswise dimension of the die casting ingots (e.g. for switching from one production component to another) entails changing the ingot molds. And finally, due to shrinkage during solidification, part of the rheocast material in the ingot mold is unusable and therefore scrapped.

SUMMARY OF THE INVENTION

It is an object of the present invention to provide a semiliquid casting process designed to preserve the advantages of known processes while at the same time enabling the production of ingots suitable for die casting and featuring none of the aforementioned drawbacks.

According to the present invention, there is provided a process for producing rheocast ingots, particularly from which to produce high-mechanical-performance die castings, and comprising stages consisting in:

smelting a metal alloy; and semiliquid casting said metal alloy, collected under stationary rheological conditions in a pressurized furnace, by feeding it at the solidification stage and under laminar flow conditions into a static mixer, so as to obtain a semiliquid rheocast material at the outlet of the static mixer;

characterized by the fact that it also comprises stages consisting in:

collecting said rheocast material at the outlet of the static mixer under laminar flow conditions and through a cooled metal die, and solidifying it into a single constant-section billet; and feeding said billet past cutting means for cutting the billet into pieces.

BRIEF DESCRIPTION OF THE DRAWINGS

A non-limiting embodiment of the present invention will be described by way of example with reference to the accompanying drawings in which.

DETAILED DESCRIPTION OF THE INVENTION

Figure 1:
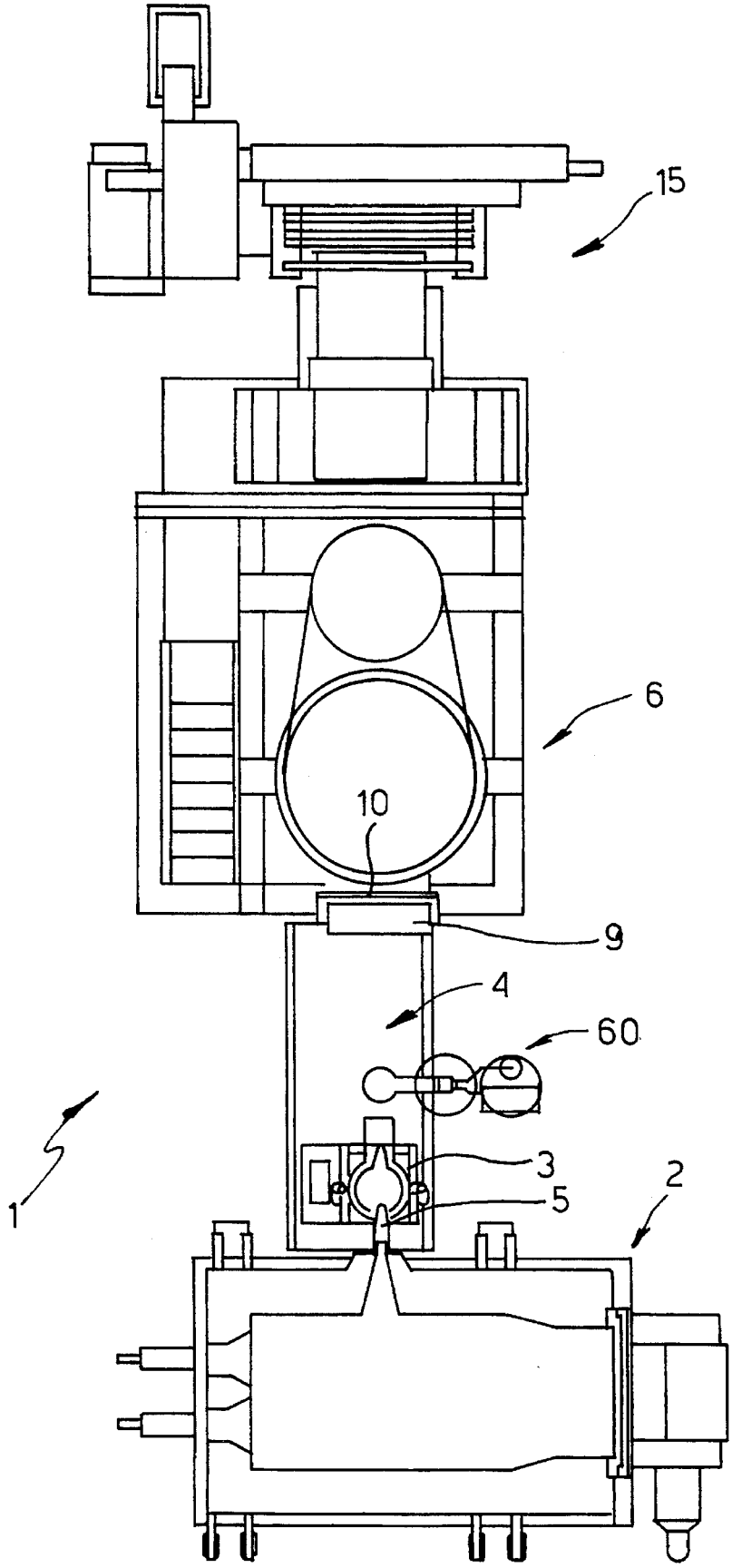
FIG. 1 shows a schematic top plan view of a system implementing the process according to the present invention.
Figure 2:
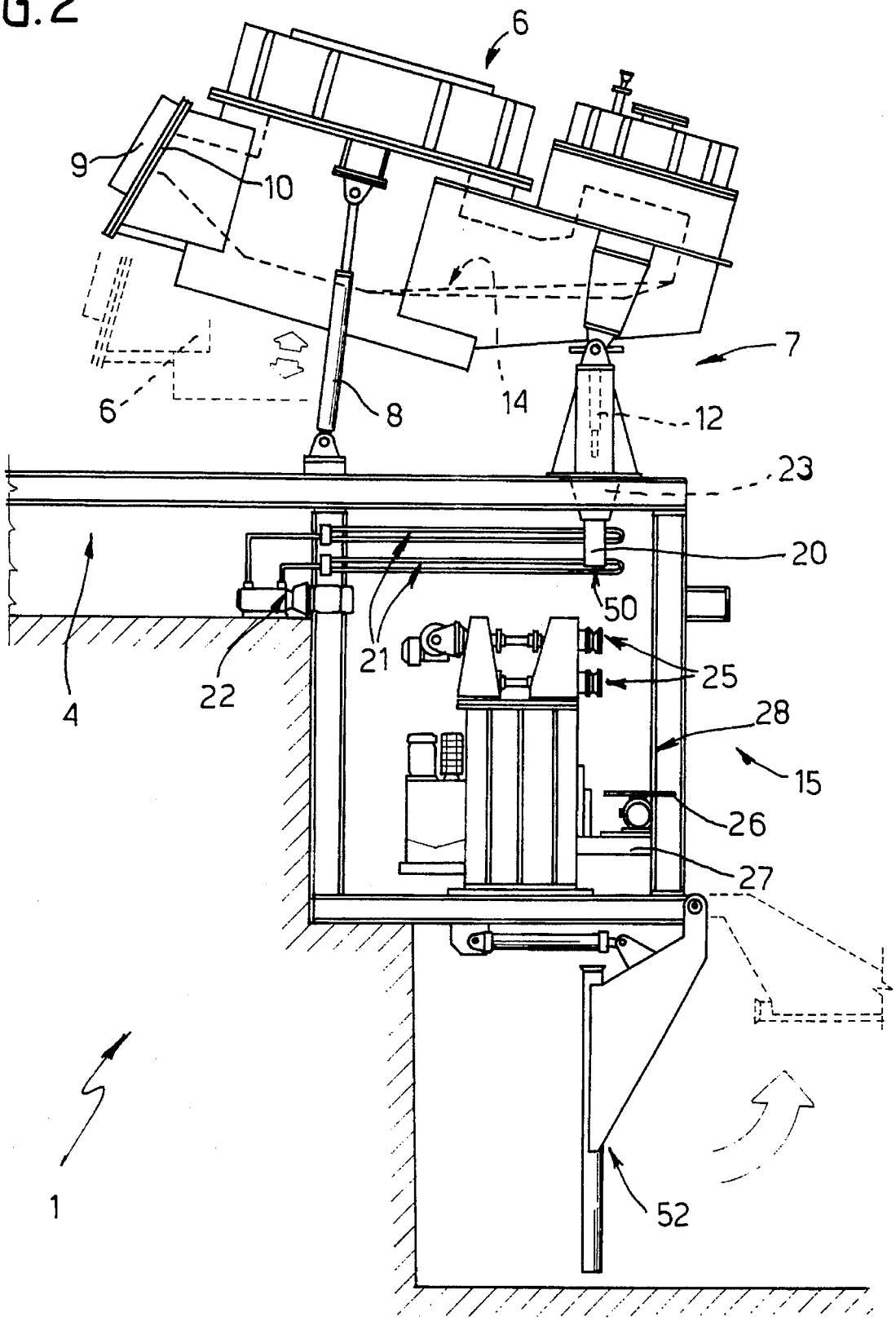
FIG. 2 shows a larger-scale side view of part of the FIG. 1 system.
Figure 3:
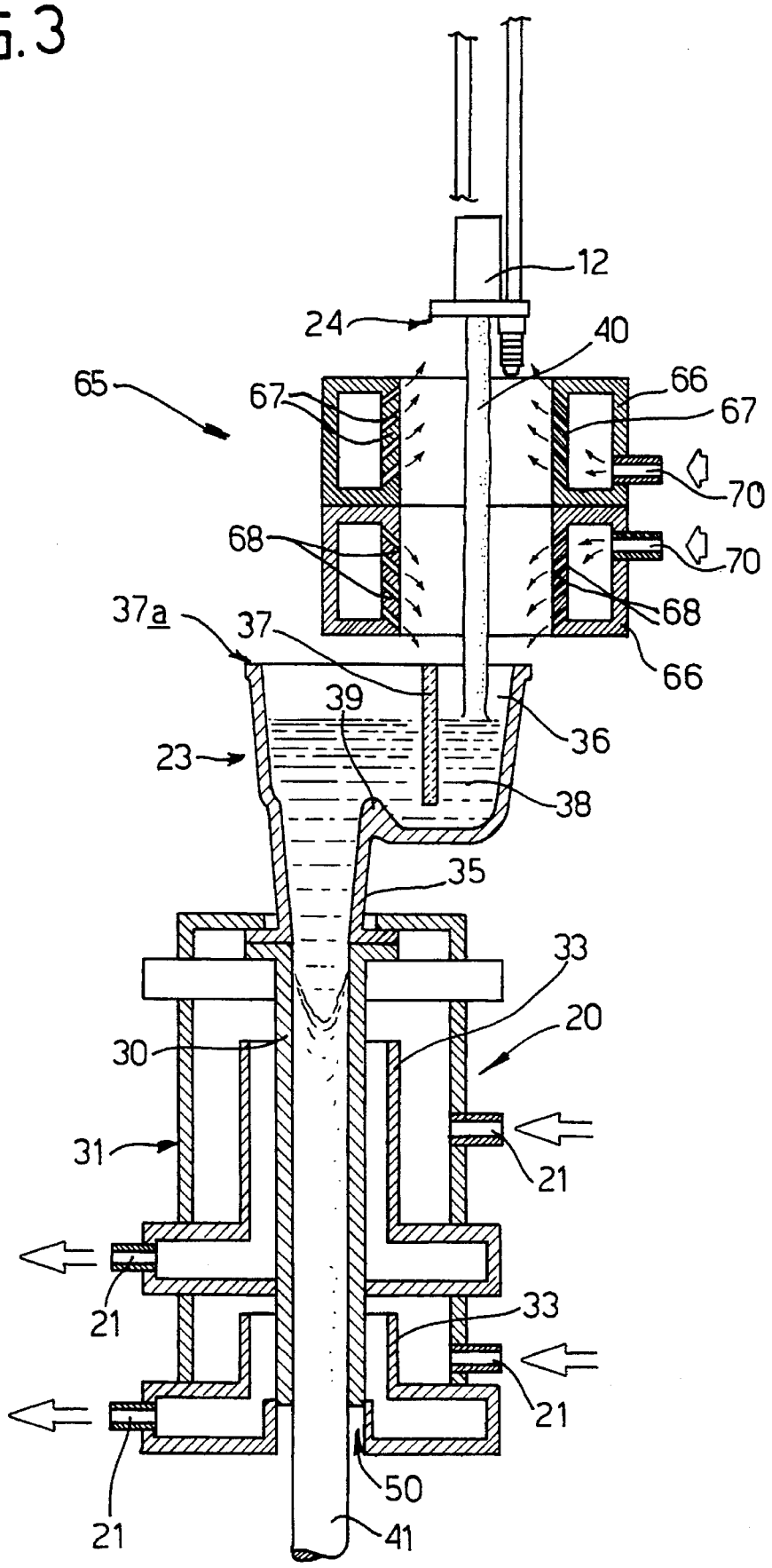
FIG. 3 shows a larger-scale cross section of a detail in FIG. 2.

With reference to FIGS. 1–3, number 1 indicates a system for producing rheocast ingots (not shown) of desired weight and size, and suitable for semiliquid die casting as described in U.S. patent application Ser. No. 07/870,494 filed by the present Applicant and mentioned previously.

System 1 comprises a conventional smelting furnace 2, e.g. an electric reverberatory furnace, for receiving and smelting a solid metal alloy, preferably aluminium alloy, e.g. in the form of pigs; a powered ladle 3 running along rails 4 and designed to receive, from runner 5 on furnace 2, the liquid alloy with or without ceramic particles fed directly into the liquid alloy in furnace 2; and a flowing furnace 6 (FIG. 2) of the type described in U.S. Pat. No. 5,119,977 already mentioned.

Being fluidtight, furnace 6 may be pressurized as required, and is mounted on a fixed support 7 and rocked by actuators 8 between an idle position (shown by the dotted line in FIG. 2) and an operating position (shown by the continuous line) assumed during casting as described in detail later on. Furnace 6 presents a loading door 9 facing rails 4 and preferably fitted with a filter 10; and a static mixer 12 of the type described in U.S. Pat. No. 4,310,352 filed by the present Applicant and mentioned previously. Inside, furnace 6 (FIG. 2) presents a siphon type tank 14 for storing and maintaining the liquid alloy at roughly 50° above the temperature at which it begins to solidify. Static mixer 12 is supported directly at the bottom of furnace 6, and, with furnace 6 in the operating position shown by the continuous line in FIG. 2, is connected hydraulically to the inside of tank 14. With furnace 6 pressurized and in the tilted position, therefore, it is possible to pour the molten metal alloy in the semiliquid state and under strictly laminar flow conditions through mixer 12, while maintaining the rest of the molten alloy in tank 14 under stationary rheological ( i.e. pressure/speed/potential energy) conditions, thus preventing any hydraulic disturbance in tank 14 capable of affecting laminar flow through mixer 12.

System 1 also presents means 15 for receiving the stream of rheocast material at the outlet of mixer 12 (semiliquid metal alloy, with or without stably suspended ceramic particles) , and for solidifying and subsequently forming it into ingots. According to the present invention, means 15 comprise (FIG. 3) an extruder or metal die 20 cooled, for example, by forced circulation of water along pipes 21 and by means of a motor-driven pump 22; a tank 23 made for example of refractory material, for collecting the semiliquid rheocast material and located downstream from the outlet end 24 of mixer 12 and immediately upstream from die 20; a series of powered guide rollers 25 (FIG. 2) beneath die 20; and a circular saw 26 mounted on a powered platform 27 traveling along and parallel to rails 28.

In particular, die 20 comprises a cylindrical forming conduit 30 made of good heat conducting material, e.g. copper, and having a jacket 31 cooled by water (or other coolant), connected internally to pipes 21, and having partitions 33 for enhancing turbulent flow and, hence, the heat exchange capacity of the coolant. Conduit 30 is butt connected directly to outlet 35 of collecting tank 23, which, according to the present invention, is a siphon type, and comprises a collecting portion 36 separated from outlet 35 by a partition 37 flush with the top edge **37*a* of tank 23 and of such a height as to project from the free surface of a bath of semiliquid rheocast material 38 (FIG. 3) in tank 23. Collecting portion 36 is also separated from outlet 35 by a spur 39 offset in relation to partition 37 and formed at the bottom of tank 23, flush with outlet 35**.

As such, the outflow stream 40 of semiliquid rheocast material from end 24 of mixer 12 is collected inside portion 36 from which it flows into the rest of tank 23, at outlet 35, with no effect whatsoever on the hydraulic conditions of material 38 stored in tank 23 as a whole, and is fed from tank 23 through die 20 under stationary rheological and strictly laminar flow conditions. As it flows along conduit 30, material 38 solidifies and forms, at the outlet of die 20, a single, continuous, constant-section billet 41. The distance between tank 23 and outlet end 24 is kept as short as possible, compatible with construction and operating requirements. By virtue of the storage function of tank 23, any turbulence originating in rheocast material 38 as a result of outflow stream 40 is limited to portion 36, and is anyway rendered negligible by virtue of the level of semiliquid material 38 being substantially constant and close to edge **37*a* under operating conditions. From outlet 35, the rheocast material then flows directly into forming conduit 30** with absolutely no possibility of any turbulence originating.

As a result of eliminating turbulence and providing for stationary rheological conditions inside tank 23 and direct hydraulic connection of tank 23 to die 20, material 38 solidifies into a single billet 41 incorporating substantially no gaseous substances.

Once formed, billet 41 is fed out through outlet 50 of die 20 and in known manner on to powered guide rollers 25, which are rotated so as to feed it parallel to rail 28 along which powered circular saw 26 is mounted in sliding manner. Saw 26 travels along rail 28 together with billet 41, and, at the same time, cuts it into pieces which are collected by a device 52 (FIG. 2) beneath guide rollers 25. Upon a given number of pieces being fed into device 52, this is moved into the position shown by the dotted line in FIG. 2, for transferring the pieces of billet 41 to the user facility, e.g. on a known conveyor belt (not shown). Device 52 is then restored to its original position beneath rollers 25, for collecting further pieces cut off continuous billet 41.

As the cross section of billet 41 is constant, the pieces cut off the billet may be cut further to size to obtain ingots of exactly the required weight and ready for use in the semiliquid die casting process mentioned previously. Alternatively, by appropriately selecting the axial position in which billet 41 is cut by saw 26, the billet may be cut directly into ingots of given weight and size.

For eliminating substantially all the gaseous substances in the rheocast material and, hence, in the ingots, system 1 may also comprise means for eliminating any gaseous substances contained in the initial metal alloy and any possibly incorporated during smelting and pouring in/from furnace 2. In particular, system 1 comprises a known degassing station 60 located at a given point along rails 4 between furnaces 2 and 6, and which provides for receiving powered ladle 3 as it travels along rails 4, for reducing the hydrogen content of the molten alloy, and for eliminating most of the gaseous substances possibly incorporated as a result of the turbulence originating during transfer of the alloy to ladle 3. System 1 also comprises ejector means 65 (FIG. 3) between static mixer 12 and tank 23, for reducing the oxides in the alloy while still in the semiliquid state.

In particular, ejector means 65 comprise a device for creating a protective inert gas atmosphere about outflow stream 40, and consisting of a pair of hollow toroidal bodies 66 mounted coaxially one on top of the other, coaxial with outlet end 24 of mixer 12, and located beneath outlet end 24 and over tank 23, so that the continuous outflow stream 40 of rheocast material between static mixer 12 and tank 23 is forced to flow through and along the axis of bodies 66. Each body 66 presents a respective series of nozzles 67, 68, and a connecting pipe 70 to a pressurized protective gas source (e.g. inert gas). Nozzles 67 and 68 are oriented obliquely in relation to the axis of bodies 66 and in opposite directions to each other. In the example shown, nozzles 67 of body 66 closest to mixer 12 are oriented towards mixer 12, i.e. upwards; while nozzles 68 of body 66 closest to tank 23 are oriented downwards and diverge from nozzles 67.

Nozzles 67, 68 thus provide for feeding into bodies 66 and about outflow stream 40 two diverging streams of gas, which may even differ chemically, so that laminar flow of rheocast material 38 through die 20 is effected under a shield of protective gas for further reducing possible contamination and, above all, for reducing the formation of oxides in stream 40 thanks to the protective action of the gas from nozzles 67, 68.

The advantages of the system and process according to the present invention will be clear from the foregoing description. Firstly, forming the rheocast material into one continuous billet, by feeding it under laminar flow conditions through a cooled die of the type used for continuous steel casting, provides for eliminating any turbulence whatsoever and, hence, for preventing gaseous substances from being incorporated in the molten alloy. It should be pointed out that this would not be possible, for example, if the billets, as is customary in the case of light alloys, were to be cast continuously using so-called "rice fields" i.e. tanks having a number of outlets through which a number of billets are formed simultaneously. In the first place, the rheocast material, being of a very high density, would not have sufficient energy for the casting to be completed; and, secondly, such a technique inevitably results in turbulence and incorporation of gaseous substances, which is precisely what is to be avoided.

Secondly, the process according to the present invention enables troublefree production from the billet, i.e. from the pieces cut off the billet by saw 26, of ingots of the required weight and size. By virtue of the billet presenting a constant section, in fact, the weight of the ingot may be determined by simply determining the axial position in which the piece is to be cut. For producing ingots of different diameters, die 20 need simply be replaced with one featuring a conduit 30 of the required inside diameter. Finally, the process according to the present invention provides for eliminating scrap due to shrinkage of the material inside conventional ingot molds, and to the necessity of compensating for the conical shape of the same.

I claim:

1. A process for producing rheocast ingots, particularly from which to produce high-mechanical-performance die castings, and comprising in stages:

smelting a metal alloy;

semiliquid casting said metal alloy, collected under stationary rheological conditions in a pressurized furnace, by feeding it at the solidification stage and under laminar flow conditions into a static mixer, so as to obtain a semiliquid rheocast material at an outlet of the static mixer;

collecting said rheocast material at the outlet of the static mixer, and through a cooled metal die, continuously solidifying the material into a single constant-section billet, said die having an outlet; and feeding said billet past a cutter that cuts the billet into pieces;

the semiliquid rheocast material from the static mixer being collected in a tank and protected against the formation of oxides by guiding a continuous outflow stream of the material from the static mixer through a toroidal device for generating a protective atmosphere and located over the tank and at the outlet of the static mixer; the outflow stream being guided along the axis of symmetry of the toroidal device; and, simultaneously, two gas streams being injected inside the toroidal device and about the outflow stream by two respective series of nozzles oriented obliquely in relation to said axis of symmetry and in the opposite direction to each other.

2. The process of claim 1 wherein said tank is a syphon-type tank and is interposed between the static mixer and the die, and the semiliquid rheocast material is collected from the outlet of the static mixer, and wherein semiliquid rheocast material from an outlet of the tank is fed under stationary rheological conditions into a forming conduit of said die.

3. A process as claimed in claim 1, characterized by the fact that said stage for collecting the rheocast material under laminar flow conditions and through said die is effected under a shield of protective gas.

4. A process as claimed in claim 1, characterized by the fact that said metal alloy is smelted in a smelting furnace, transferred in the fully liquid state from said furnace to a ladle, and fed by said ladle and through a filter into said pressurized furnace; said alloy in said pressurized furnace being maintained in the fully liquid state, at a temperature slightly above that at which crystallization commences, and, after pressurizing the furnace to a predetermined value, being poured, by partially tilting the furnace, in the semiliquid state through said static mixer, while at the same time maintaining it under stationary rheological conditions inside the pressurized furnace.

5. A process as claimed in claim 4, characterized by the fact that, once transferred to said ladle, the molten alloy is subjected to a degassing stage to eliminate any hydrogen content, by feeding the ladle to a degassing station located between the smelting furnace and the pressurized flowing furnace.

6. A process as claimed in claim 1, characterized by the fact that, beneath the outlet of said die, said billet is collected by guide rollers and fed parallel to a rail fitted in sliding manner with a powered circular saw, which is moved along said rail together with the billet and, at the same time, cuts the billet into pieces which are collected by a device beneath the guide rollers.

7. A system for producing rheocast ingots, particularly from which to produce high-mechanical-performance die castings, said system comprising:

means for smelting a metal alloy;

a static mixer;

a pressurized furnace for semiliquid casting said metal alloy, collected under stationary rheological conditions in said furnace, by feeding it at the solidification stage and under laminar flow conditions into the static mixer, so as to obtain a semiliquid rheocast material stream at an outlet of the static mixer;

a cooled metal die through which said rheocast material from the static mixer is collected continuously under laminar flow conditions and solidified into a single constant-section billet, said die having an outlet;

means for feeding said billet past a cutter adapted to cut the billet into pieces;

a storage tank inserted between the static mixer and the die; and a toroidal device for generating a protective atmosphere and located over said tank and at the outlet of said static mixer, the semiliquid rheocast material outflow stream from said static mixer being guided along the axis of symmetry of the toroidal device, said toroidal device including two series of nozzles oriented obliquely in relation to the axis of symmetry and in the opposite direction to each other, said nozzles adapted to inject gas streams inside said toroidal device and about the material outflow stream.

8. A system as claimed in claim 7, characterized by the fact that the system further comprises a smelting furnace for smelting the metal alloy in the form of pigs; ladle means for collecting the fully liquid metal alloy from the smelting furnace and transferring it into said pressurized furnace; filtering means at an inlet of said pressurized furnace, for filtering the liquid alloy; a degassing station for receiving said ladle means at a given point along the path traveled by said ladle means between the smelting furnace and the pressurized furnace; a siphon type tank between the static mixer and the die; ejector means between the static mixer and the tank, for protecting the alloy at the semiliquid state; guide rollers for receiving the billet formed at the outlet of the die; and a circular saw moving past the rollers, for cutting the billet into pieces.

* * * * *